US005164262A

United States Patent [19]

Kobayashi et al.

[11] Patent Number: 5,164,262

[45] Date of Patent: Nov. 17, 1992

[54] POLYURETHANE POLYAMIDE SELF-CRIMPING CONJUGATE FIBER

[75] Inventors: Hirofumi Kobayashi, Aichi; Toshiyuki Takeda, Hyogo, both of Japan

[73] Assignee: Toray Industries, Inc., Japan

[21] Appl. No.: 754,365

[22] Filed: Aug. 29, 1991

Related U.S. Application Data

[63] Continuation of Ser. No. 371,396, Jun. 26, 1989, abandoned.

[30] Foreign Application Priority Data

Jun. 30, 1988 [JP] Japan ..... 63-164171

[51] Int. Cl.[5] ..... D02G 3/00

[52] U.S. Cl. ..... 428/373; 428/370; 428/371; 428/374

[58] Field of Search ..... 428/370, 371, 374, 373

[56] References Cited

U.S. PATENT DOCUMENTS 4,106,313 8/1978 Boe ..... 66/178 A

FOREIGN PATENT DOCUMENTS 50-71918 6/1975 Japan .
55-22570 6/1980 Japan .
57-34369 7/1982 Japan .
57-34370 7/1982 Japan .
62-156314 7/1987 Japan .

*Primary Examiner*—Patrick J. Ryan
*Assistant Examiner*—N. Edwards
*Attorney, Agent, or Firm*—Austin R. Miller

[57] ABSTRACT

A polyurethane polyamide self-crimping conjugate fiber having eccentric conjugate form, comprises a high hardness polyurethane having a Shore hardness D of 58 to 75 and a polyamide having a melting point of at least 200° C., which has a excellent extension stress properties and excellent heat resistance. The conjugate fiber is suitable for hosiery products and tricot products, having excellent transparent of fabric and a high level of fitting properties.

11 Claims, 1 Drawing Sheet

POLYURETHANE POLYAMIDE SELF-CRIMPING CONJUGATE FIBER

This application is a continuation of application Ser. No. 07/371,396, filed Jun. 26, 1989, now abandoned.

BACKGROUND OF THE INVENTION (1) Field of the Invention

The present invention relates to a self-crimping conjugate fiber comprising a polyurethane and a polyamide.

Particularly, the invention relates to a polyurethane polyamide conjugate fiber which exhibits excellent recovery stress properties and heat resistance and which is particularly useful as a fiber material for hosiery with excellent close-fitting properties and transparency.

(2) Description of the Prior Art

Self-crimping conjugate fibers comprising polyurethanes and polyamides which are eccentrically combined with each other can be formed into fabrics having good stretchability and transparency and are thus highly valued as filament materials for making high-quality stockings.

Examples of known polyurethane elastomer components that may be used in such conjugate fibers include polyurethanes obtained by reaction between diisocyanates and polyols, and then by chain extension using a low-molecular weight glycol and/or low-molecular weight diamine such as hydrazine or ethylenediamine. Useful polyols are, for example, polyethers comprising polyalkylene oxides and polytetrahydrofuran; polylactone obtained by ring opening polymerization of $\epsilon$-caprolactone; polyesters obtained by condensation polymerization of acids such as adipic acid, glutaric acid and glycols such as ethylene glycol, propylene glycol, and polycarbonate.

It is considered that, of these polyurethane components, polycarbonate-urethanes having excellent resistance to separation from polyamide components and relatively excellent heat resistance are preferable, and are used together with other polyurethanes such as polyester-urethanes, polyether-urethanes, which is described in Japanese Patent Publication Nos. 55-22570 and 57-34370.

In addition, it has been generally considered that such polyurethanes must have a Shore hardness A within the range of 90 to 100, which is measured in accordance with the measurement method described as method A in JIS K6301. That is, it has been considered that, since polyurethanes having Shore hardness A over 100 exhibit lower degree of extension than that of polyurethanes having Shore hardness A of 100 or less, polyurethane polyamide conjugate fibers obtained by using such polyurethanes having Shore hardness A over 100 exhibit poor crimping properties. Furthermore, it has been thought that the viscosity of polyurethanes having Shore hardness A over 100 cannot be easily stabilized during melt spinning, and thus yarns cannot be easily formed by using such polyurethanes. This has lead to a situation in which it has been substantially impossible to use such polyurethanes in industrial spinning process, which is described in Japanese Unexamined Patent Publication Nos. 50-71918 and 62-156314.

Although polyurethane polyamide conjugate fibers having excellent coil-like crimps can be formed even by using polyurethanes with Shore hardness A of 100 or less, it cannot be said that the stretch fabric products such as stockings that are thereby produced have satisfactory close-fitting properties. There has therefore been a demand for fabric products exhibiting improved recovery stress properties and superior close-fitting properties and transparency.

It is also necessary for polyurethanes to have a certain level of heat resistance for composite melt-spinning with polyamides. It is therefore preferable to use polyurethanes containing polycarbonate-urethanes, as described above. In the case of a polyurethane containing polycarbonate-urethane with Shore hardness A of 100 or less, the polyurethane exhibits a significantly lower level of heat resistance than that of a polyamide. There has therefore been a problem in that the stretch products so formed cannot be satisfactorily subjected to heat setting, because heat setting can be effected only at a relatively low temperature without heat deterioration of the polyurethane component. Further, in some cases, the stretchability and high degree of product of strength and elongation of the products may deteriorate even if heat setting is performed at a relatively low temperature.

SUMMARY OF THE INVENTION

Accordingly, it is an object of the present invention to provide a polyurethane polyamide conjugate fiber which is very useful for obtaining excellent hosiery products having a high level of close-fitting properties and excellent transparency.

It is another object of the present invention to improve the recovery stress properties of an eccentric conjugate fiber comprising polyamide and polyurethane elastomers, which has been subjected to a treatment for crimp development, and to provide a polyurethane polyamide conjugate fiber which is capable of improving the heat resistance of and preventing any deterioration of the characteristics of products during heat treatment.

BRIEF DESCRIPTION OF THE DRAWINGS

In FIGS. 1 and 2, the polyurethane 1 and the polyamide 2 compose eccentric conjugate forms.

DETAILED DESCRIPTION OF THE PREFERRED EMBODIMENT

Figure 1:
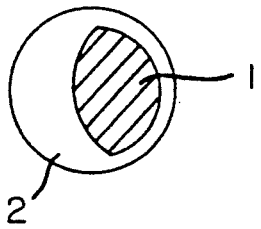
FIGS. 1 and 2 are respectively cross sectional views of fibers which are illustrated as examples of a conjugate fiber structure in accordance with the present invention.

The present invention is mainly characterized by the use of a polyurethane having a Shore hardness D of at least 58 as a polyurethane component of a polyurethane polyamide conjugate fiber and is consequently capable of providing a polyurethane polyamide conjugate fiber having such a high level of recovery stress properties that the spring constant of the crimped fiber after crimp development treatment is at least 14.

The Shore hardness D of the polyurethane is a value obtained by measurement in accordance with the measurement method described in ASTM-D-2240, which is measured by type D durometer hardness tester. There is a certain correlation between the Shore hardness D and the above-described Shore hardness A, the Shore hardness D of 58 being substantially at the same level as a Shore hardness A of 101. The Shore hardness D is used for indicating Shore hardness A within the hardness range above 100 which cannot be easily measured by using Shore hardness A, and is thus used in the present invention.

Although a polyurethane homopolymer, polyurethane copolymer or polyurethane mixture may be used as the polyurethane in the present invention, it is important that the level of hardness is as high as at least 58 in terms of Shore hardness D, particularly preferably a Shore hardness D of at least 60.

The higher the value of the Shore hardness D, the better are the recovery stress properties and the heat resistance of the conjugate fiber. However, if the Shore hardness D is too high, melt spinning itself becomes difficult, and the degree of elongation will then significantly decrease. The practical limit of Shore hardness D is thus about 75, preferably about 70 or less.

As the Shore hardness of the polyurethane does not substantially change during melt spinning and/or heat treatment, the value of the Shore hardness can be ascertained from a polyurethane polymer before spinning or from the polyurethane component in the conjugate fiber before or after crimp development or after further heat setting.

The hardness level of the polyurethane can be easily set by changing the ratio of the crystal forming portion (hard segment), the polymer viscosity, the amount of cross-linking points and the kind of polyol component. For example, the hardness of the polyurethane is effectively increased by increasing the ratio of the crystal forming portion (hard segment) in the polyurethane, the polymer viscosity, the crosslinking points in the polymer, using a hard polyol such as polycarbonate and/or reducing the molecular weight of the polyol. The ratio of the crystal forming portion (hard segment) of the polyurethane can be increased by raising the content of a chain extender such as a low-molecular weight diol and/or diamine.

It is particularly preferable that the weight ratio between the hard segment, formed from chain extender such as a low-molecular weight diol and/or diamine, and the soft segment formed from polyol component, is within the range of 17:83 to 25:75 in terms of ratio by weight.

Any of such known polyurethanes as polycarbonate-urethanes, polyester-urethanes, polylactone-urethanes and polyether-urethanes may be used as the polymer which forms the polyurethane component in the form of a homopolymer or copolymer of polyurethane or a mixture thereof. Of these polyurethanes, polycarbonate-urethanes or polyurethanes containing polycarbonate-urethanes of at least 10 percent by weight as copolymer components or mixture components are preferable for increasing the degree of adhesion to polyamides.

The polyurethane may contain other polymers such as polyesters, polyisocyanates, or low-polymerization compounds (molecular weight; about 500 to 3000) having urethane groups so far as they have low contents thereof (for example, 20% by weight or less, preferably 10% by weight or less), which do not inhibit such characteristics as the resistance to separation from polyamides, thermal plasticity, heat stability, and a high degree of strength, elongation and elasticity. Examples of low-polymerization compounds having urethane groups include diisocyanate compounds such as diphenylmethane diisocyanate, tolylenediisocyanate, lysineisocyanate and the like.

Examples of polyols that may be used for obtaining the above-described polycarbonate-urethanes include aromatic polycarbonates obtained from 4,4'-dioxydiphenyl-2,2'-propane (bisphenol A), aliphatic polycarbonates obtained by reaction between aliphatic bivalent alcohols and phosgene, and the like. The molecular weights of the polycarbonate-polyols are preferably about 600 to 5000.

Examples of polyols that may be used for obtaining the polyether-urethanes include poly(oxyethylene) glycol, poly(oxypropylene) glycol, poly(tetramethylene) glycol and the like. The molecular weights of the polyether-polyols are preferably about 600 to 4000.

Examples of polyols that may be used for obtaining the polyester-urethanes include polyesters with molecular weights of about 600 to 4000, which are obtained by condensation reaction between acids such as adipic acid, glutaric acid, sebacic acid or the like, and glycols such as ethylene glycol, 1,4-butylene glycol, 1,3- or 2,3-butanediol, 2,5-hexanediol.

Further, the molecular weight of the polycarbonate-polyols is preferably 1 to 6 times that of the polyols other than polycarbonate-polyols, more preferably 1 to 3. In the case of the molecular weight ratio is less than 1, conjugate yarns with sufficiently good heat resistance and fitting properties are hardly obtained.

Examples of diisocyanates that may be used for obtaining polyurethanes include diphenylmethane diisocyanate, tolylenediisocyanate, naphthalenediisocyanate, isophoronediisocyanate, lysineisocyanate and the like. Examples of chain extenders include low-molecular weight glycols, hydrazine, ethylenediamine, bis-$\beta$-hexanone and the like. The molar ratio (—NCO/—OH) between the —NCO terminal groups and —OH terminal groups in the material for polymerization may be about 1.00 to 1.10.

This polymerization material is subjected to polymerization using an ordinary polyurethane polymerization method such as a one-shot process or prepolymer process. The obtained polyurethane may be subjected to polymer mixing and additive mixing to form a polyurethane component to be used for composite spinning in accordance with the present invention.

Although such a high-hardness polyurethane has a tendency to display deviations in the viscosity during melt spinning, this tendency can be suppressed by controlling the degree of polymerization of the polyurethane used to stay within an appropriate range corresponding to the polyurethane composition. The degree of polymerization of the polyurethane can be controlled to stay within an appropriate range by adjusting its melt viscosity, and it is generally preferable that the melt viscosity is between about 3500 and 35000 poise.

It is also preferable in terms of stabilizing the viscosity during melt spinning that the viscosity of the polyurethane is within the range of 1.60 to 3.00 relative to dimethylacetamide, more preferably within the range of 1.70 to 2.80. The value of viscosity relative to dimethylacetamide is closely related to the stability during melt composite spinning with the polyamide component and spinning properties such as yarn breakage during the spinning and drawing process. The stability during melt spinning is such as thermal stability in a spinning pack, yarn breakage just after spinning out. The high-hardness polyurethane having Shore hardness D of at least 58 can therefore be stably subjected to melt composite spinning on an industrial scale by controlling the value of the viscosity to stay within an appropriate range.

When the viscosity of the polyurethane relative to dimethylacetamide is over 3.00, significant deterioration in the fluidity caused by an increase in the viscosity during melt spinning causes gelation to be promoted and thermal decomposition to easily occur, resulting in the deterioration in the stability during melt spinning and yarn-making properties. On the contrary, when the viscosity relative to dimethylacetamide is less than 1.60, the polyurethane exhibits unsatisfactory properties of fiber formation and thus poor properties of yarn making, and thus conjugate fibers which can be fit for practical use cannot be easily obtained.

The viscosity of the polyurethane relative to dimethylacetamide is measured by the following method:

0.25 g of a polyurethane sample is dried under reduced pressure at 50° C. for 16 hours and then dissolved in 25 ml of dimethylacetamide of room temperature by a shaking method for 2 to 5 hours. The relative viscosity of the resultant solution is measured by using an Ostwald viscometer at 25° C. under the condition that the falling time is 40 seconds.

The viscosity of the polyurethane relative to dimethylacetamide can be adjusted by appropriately selecting methods and conditions of polymerization, melting and spinning, which are, for example, a method of re-melting and pelletizing a polymer (pellet) and a method of adjusting the melt spinning temperature corresponding to the level of viscosity of the polymer used.

It is necessary that the polyamide component used in the present invention has a melting point of at least 200° C. Examples of polyamides having melting point of at least 200° C. include nylon 6, nylon 66, nylon 46 and nylon 6 10. Although many polyamide copolymers have melting points less than 200° C., polyamide copolymers having melting points of at least 200° C. may be also used. Since the conjugate fibers obtained from polyamides having excessively low melting points exhibit poor physical properties such as the degree of extension, wear resistance and so on, it is difficult to obtain fibers, which can be fit for practical use, from such polyamides. On the other hand, it is undesirable to use polyamides having excessively high melting points for composite spinning with polyurethanes, and it is preferable from the viewpoint of practical use that polyamides have melting points of at most about 300° C. Of these polyamides, particularly, polyamides essentially formed from nylon 6 or nylon 66 are more preferable. The degree of polymerization of the polyamide component may be a value corresponding to relative viscosity $\eta r$ which is generally employed for clothing fibers, for example, relative viscosity to sulfuric acid of 2.0 to 2.8. The polyamide component may contain general additives such as a heat-resisting agent, a light-resisting agent, a delustlant agent and forth.

The above-described high-hardness polyurethane and polyamide may be subjected to melt composite spinning using the method which is basically the same as that used in conventional melt composite spinning of polyamides and polyurethanes. For example, these polymers are supplied to a normal melt composite spinning machine and separately molten therein, and then subjected to composite spinning using a composite spinneret heated at about 230° to 290° C. The polyamide component is then subjected to crystal orientation using a normal method to produce a conjugate fiber with latent crimping properties.

Examples of fiber-making methods include a two step method in which yarns are wound up at a low speed to form undrawn yarns and then drawn with or without heat-treatment; a direct spinning drawing method in which yarns are taken up at a low speed, drawn and then subjected to heat treatment using a means such as a hot roller, steam treatment or the like; and a high-speed spinning method in which yarns are wound up at a high speed, without drawing or with some drawing of a relative low degree. The high-speed spinning method employs such conditions that the take-up speed is at least 3500 m/min., the degree of drawing is at most 2.5 times, and the wind-up speed is at least 4000 m/min. Some heat treatment during yarn-making process is effective to decrease the fiber-shrinkage in boiling-water, so that conjugate yarn with low shrinkage useful for stockings can be obtained.

Figure 2:
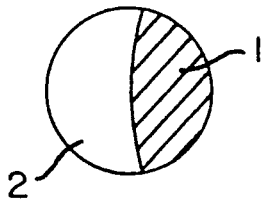

The conjugate fiber structure may be an eccentric conjugate structure which allows the attainment of latent crimping properties that allow coil-like crimps to be produced by the crimp developing treatment. For example, the eccentric sheath-core conjugate structure such as shown in FIG. 1 is preferable, but the side-by-side conjugate structure shown in FIG. 2 may be used. These conjugate structures can be subjected to composite spinning using ordinary composite spinnerets.

Although the optimum value of the compounding ratio of the polyurethane component and the polyamide component depends upon the conjugate structure used, the compounding ratio is generally about 80/20 to 20/80, preferably about 70/30 to 30/70. It is also preferable that at least half of the external peripheral surface of the fiber is occupied by the polyamide, and preferably 80% or more, more preferably substantially the entire external peripheral surface of the fiber is occupied by the polyamide. That is, since the exposure of the polyurethane component from the external peripheral surface of the fiber easily causes deterioration in the spinning properties and after processing properties, if possible, no polyurethane component is preferably exposed from the external peripheral surface of the fiber.

It is preferable for obtaining good crimping properties that the single fiber fineness of the polyurethane polyamide conjugate fiber of the present invention is at most 40 denier, preferably about 3 to 40 denier. Although the yarn fineness and the number of filaments depend upon end use, for example, the yarn fineness and the number of filaments for leg portion of stockings, and tights are preferably 10 to 40 denier and 1 to 12 filaments; 30 to 70 denier and 1 to 24 filaments, respectively.

Since an increase in the hardness of a polyurethane generally causes deterioration of its stretching properties, the hardness of polyurethane for an elastic fiber formed from polyurethane alone cannot be significantly increased, and no polyurethane having Shore hardness D of 58 or more is used, for an elastic polyurethane fiber. In the case of a conjugate fiber comprising a polyurethane and polyamide, it was generally considered that such a conjugate fiber must have a level of hardness of polyurethane, which is substantially the same as that of a elastic fiber formed from polyurethane alone, for the purpose of obtaining enough self-crimping properties.

However, when a conjugate fiber is actually produced by using a high-hardness polyurethane, although there was a tendency that the stretching properties deteriorate as the hardness increases, no critical deterioration in elasticity was actually observed. It was rather found that the recovery stress properties and heat resistance are improved as the hardness increases, and crimped fibers extremely useful for stockings can be formed owing to the significantly improved fitting properties and heat resistance of fabric products. It is thought that this is because, in the case of the conjugate fiber, the elastic properties possessed by the conjugate fiber which was subjected to crimp developing treatment are mainly attributed to the coil-like crimps, which produced by using the difference in shrink properties between the polyamide and the polyurethane, and hardly depend upon the stretching properties possessed by the polyurethane component.

The conjugate fiber formed by eccentrically compounding the high-hardness polyurethane and the polyamide are subjected to crimp developing treatment using a normal method to exhibit elastic properties as a coil-like crimped fiber. Such a coil-like crimped fiber has such a high level of stretch recovery stress that the spring constant is 14 or more and that has not been obtained so far. Since the fiber has a high spring constant, the 60% recovery stress and 70% stretch stress of the stretch fabric product obtained are significantly increased, as well as the fitness thereof being significantly improved.

The spring constant (K) of coil-like crimped fiber is the value obtained by the following method:

A fiber yarn sample having latent crimping properties is treated with boiling water at 98° C. for 30 seconds to develop coil-like crimps. One end of the coil-crimped yarn sample is fixed, and a load (W mg) of 35 mg/d is applied to the other end so as to stretch the yarn sample. The length ($\sigma$mm) of one coil pitch in the stretched yarn sample and the length ($\sigma_0$ mm) of that in the not-stretched yarn are measured. The spring constant (K) is determined by using the following equation:

$$K=[W/(\sigma-\sigma_0)]\times 10^{-2}(\text{g/cm})$$

The conjugate fiber is also excellent in its heat resistance. For example, the retention of the product of strength and elongation (refer to the examples described below) after the fiber has been subjected to the crimp developing treatment using boiling water and then heat setting at 110° C. is as high as 70 percent or more.

Since the fiber has excellent heat resistance, the deterioration of the physical properties owing to the crimp developing treatment and heat setting is suppressed, and the strength-elongation properties of the fibers used in the stretch fabric product are significantly improved as compared with conventional polyurethane polyamide fibrous fabrics.

In addition, since the high-hardness polyurethane used in the present invention exhibits a relatively high melting point and excellent heat resistance, it is possible to used as polyamide components relatively high-melting point polyamides such as nylon 66 and the like, which is generally considered to be subjected to composite spinning together with polyurethanes with difficulty in the industrial field.

EXAMPLE 1

A polyurethane polymer was formed by polymerization by a normal one-shot process using a mixed polyol containing a polycarbonate (average molecular weight, 3000) and a polycaprolactone (average molecular weight, 1000) in a ratio of 5:5, 1,4-butylene glycol as a chain extender, and diphenylmethane diisocyanate as a diisocyanate. The thus-formed polymer was chopped into flakes, melt-extruded by using an extruder and then pelletized.

The molar ratio (—NCO/—OH) of the —NCO groups to the —OH groups in the raw material used for polymerization was 1.04. The molar ratio between 1,4-butylene glycol and the mixed polyol was 5.5 so that polyurethanes having Shore hardness D of 63, which were used as polymer A.

The Shore hardness D, viscosity relative to dimethylacetamide, ratio between hard segment and soft segment, and degree of elongation of the thus-obtained polyurethanes were measured. The results obtained are shown in Table 1.

The above-obtained polyurethane and a polycapramide having viscosity relative to 98 percents sulfuric acid of 2.50 were separately molten at 230° C. and 260° C. and then supplied to a composite spinning machine. The both polymers were then compounded together and spun out in an eccentric form having a core and a sheath in a ratio of 50/50 using a composite spinneret heat at 250° C., and then cooled by a ordinary method. Spinning oil was supplied to the cooled filaments, and then wound up at 600 m/min. The as-spun filaments were then drawn at a ratio of 4.0 times without heat-treatment, to form a conjugate filament yarn with latent crimping properties, which has two filaments and 18 denier. The thus-obtained filament yarn had a conjugate structure in an eccentric form having a core and a sheath, as shown in FIG. 1.

A stocking was formed by knitting the thus-formed yarns by a ordinary method and then subjected to the heat setting treatment at 110° C. to produce a stocking product.

The strength-elongation properties, the spring constant after crimp developing treatment of the conjugate filament yarn without being knitted, the physical properties of the coil-like crimped yarn in the stocking product, and the elastic properties and elongation recovery stress properties of the stocking product were measured. The results obtained are also shown in Table 1.

The above-described physical properties were respectively measured by the following methods:

Spring constant; measured after the conjugate filament yarn has been subjected to crimp developing treatment by the above-mentioned manner without being knitted.

Retention of product of strength and elongation; The product of strength and elongation is calculated from the value of yarn strength (g/d) and yarn elongation (percent), which are measured by ordinary manner.

The product=strength (g/d) X [elongation (%)/100 +1] And, ratio (percent) of the product of the fiber after being heat-set to that of a fiber before heat-set, is calculated.

Crimping properties of stockings; A sample obtained by folding a stocking product in two was subjected to a tension test using a constant extension-type tensile tester (manufactured by Shinko Tsushin Kogyo Co., Ltd.). The stretched length (L1) of the sample which was subjected to a load of 2 Kg was measured. And then, the stress value (g) at a point of extension of 75 percents of said L1 was read from the hysteresis curve which was formed by affecting extension of 75 percents of L1 and recovery, and the stress value (g) at a point of recovery of 60 percents of L1 was read from the recovery curve. These values were divided by 2 and respectively shown as values of 75 percents extension stress (75% SP) and 60 percents recovery stress (60% BP). These values are indexes which indicate the fitting properties of stockings, and the higher the values, the more excellent the fitting properties. The fitting properties were evaluated by tests which were performed by actually putting on the stockings.

EXAMPLE 2

Yarns were formed by the essentially same method as in EXAMPLE 1 with the exception that the molecular weight of the polyols, ratio of mixed polyols, and the molar ratio between 1,4-butylene glycol and the mixed polyol of the polyurethane supplied to composite melt-spinning was changed. That is, average molecular weight of the polycarbonate is 2000, that of polycaprolactone is 2000, ratio of mixed polyols between a polycarbonate and a polycaprolactone is 6:4, and the molar ratio between 1,4-butylene glycol and the mixed polyol was 6.0, 5.5, 5.0 or 4.0 so that four types of polyurethanes having different levels of Shore hardness, were obtained, which were respectively used as polymers B, C, D and E.

The obtained conjugate yarns evaluated as the same manner in EXAMPLE 1, and the results are also shown in Table 1.

As can be seen from Table 1, the conjugate fibers comprising polyurethanes having Shore hardness D of 58 or more, as Sample Nos. A to D, exhibited low degrees of elongation of raw yarns, as compared with the conjugate fiber (No. E) comprising a polyurethane having Shore hardness D less than 58, but they exhibited significantly improved heat resistance and extension stress properties after crimp development and thus could be formed into stockings having excellent fitting properties and strength-extension properties.

EXAMPLE 3

Yarns were formed by the essentially same method as in EXAMPLE 2 (Test No. C) with the exception that the molecular weight of the polyol of the polyurethane supplied to composite melt-spinning used in EXAMPLE 1 was changed to the values shown in Table 2, and then evaluated. The results are shown in Table 2.

As can be seen from Table 2, the conjugate fibers comprising polyurethane having the ratio of average molecular weight of between polycarbonate and caprolactone of at least 1 exhibited more excellent fitting properties than that having the ratio of less than 1.

EXAMPLE 4

The as-spun yarn obtained in Test No. C and E of EXAMPLE 2 were drawn at a ratio of 4.0 times with using hot plate of 30°, 60°, 80°, or 100° C., to form heat-treated filament yarns with latent crimping properties.

The strength and elongation of the obtained heat-treated filament yarns were measured as the same manner in EXAMPLE 1, and the results are shown in Table 3.

As can be seen from Table 3, the conjugate fiber (No. C) of this invention exhibited significantly improved heat resistance, therefore the conjugated fiber having low shrinkage and good strength was obtained by heat-treatment, which is useful for production of stockings.

On the other hand, the strength of the conventional conjugate yarn (No. E) having Shore hardness D of less than 58, was decreased by heat-treatment, so that no heat-treated conjugated yarn with good properties was obtained.

EXAMPLE 5

A polyurethane polymer was formed by a ordinary one-shot process as same manner as the No. C in EXAMPLE 2. The thus-formed polyurethane polymer was then chopped into flakes, ground, heated by hot air at 45° C. for 14 days, melt-extruded by an extruder (cylinder temperature; 195° to 210° C.) and then pelletized. The thus-obtained polyurethane was used as Polymer No. J.

Above obtained polymer flakes after the heat-treatment with hot air was melt-extruded by an extruder, wherein the cylinder temperature of the extruder was changed to 200° to 215° C., or 205° to 225° C. to form polyurethane elastomers which were respectively used as polymers No. K and L.

The above-obtained polymer J was again melt-extruded at a cylinder having temperature of 165° to 200° C. or 185° to 205° C. and then pelletized, respectively to form polymers M and N.

Each of the polyurethane elastomers and a polycapramide with viscosity relative to 98 percents sulfuric acid of 2.30 were supplied to a composite spinning process. Each polyurethane and the polycapramide were separately molted at 230° C. and 250° C., respectively, compounded together and co-spun out in an eccentric form having a core and a sheath in a ratio of 50/50 by using a composite spinneret heated at 240° C., and then cooled by a ordinary method. Spinning oil was then supplied to the fibers which were then wound up at 600 m/min. The fibers were then 4.0 times cold-drawn to obtain a conjugate filament yarn with 20 denier comprising 2 filaments. The results of melt-spinnability, the state of occurrence of gel in a spinning pack, and the viscosity relative to DMAc of the polyurethane components, are shown in Table 4.

The results of the spinning operation and the state of occurrence of gel in a spinning pack were evaluated using the degree of coloring (yellowing) of each polymer caused by modifiers. As can be seen from Table 4, the foaming and gelation of the polyurethane during melt spinning were suppressed by controlling the viscosity of the polyurethane components used relative to DMAc to stay within the range of 1.60 to 3.00, as shown in polymer Nos. K to M. Furthermore, the melt-spinning stability and yarn-making properties could be significantly improved.

On the other hand, the use as a polyurethane elastomer of polymer No. J having relative viscosity to DMAc of over 3.00 exhibited poor spinning and stretching properties and caused the occurrence of gel during melt-spinning, which was mixed as brown foreign matter in the fibers. In addition, the use as a polyurethane elastomer of polymer No. N having viscosity less than 1.60 relative to DMAc caused the deterioration of the spinning and drawing properties owing to the poor straight chain properties, i.e., poor properties of fiber formation.

TABLE 1

| | No. | | | | |
|---|---|---|---|---|---|
| | A | B | C | D | E(*) |
| Polyurethane | | | | | |
| Shore D | 63 | 67 | 63 | 58 | 54 |
| (Shore A, calculated) | (103) | (105) | (103) | (101) | (98) |
| Hard/Soft Segment | 19.8/80.2 | 21.3/78.7 | 19.8/80.2 | 18.4/81.6 | 15.3/84.7 |

TABLE 1-continued

| | No. | | | | |
|---|---|---|---|---|---|
| | A | B | C | D | E(*) |
| (wt. ratio) | | | | | |
| Relative Viscosity in DMAc | 2.20 | 2.18 | 2.20 | 2.12 | 2.10 |
| Polyol molecular wt. ratio | 3 | 1 | 1 | 1 | 1 |
| Conjugate Fiber (Before Heat-set) | | | | | |
| Strength (g/d) | 5.1 | 5.2 | 5.1 | 5.2 | 5.1 |
| Elongation (%) | 38 | 38 | 39 | 40 | 44 |
| Spring Constant (K) | 30.2 | 29.1 | 22.5 | 16.2 | 12.5 |
| Conjugate Fiber (After Heat-set) | | | | | |
| Strength (g/d) | 3.8 | 3.8 | 3.7 | 3.5 | 3.0 |
| Elongation (%) | 58 | 60 | 61 | 60 | 49 |
| Retention of product of strength and elongation (%) | 85 | 85 | 84 | 77 | 61 |
| Stocking | | | | | |
| 60% Recovery Stress (g) | 160 | 151 | 140 | 122 | 98 |
| 75% Extention Stress (g) | 890 | 880 | 710 | 655 | 430 |
| Fitness | excellent | excellent | excellent | good | no good |

(*)comparative example

TABLE 2

| | No. | | | | |
|---|---|---|---|---|---|
| | A | F | C | G | H |
| Polyurethane | | | | | |
| Molecular Weight of Polycarbonate | 3000 | 2000 | 2000 | 1000 | 1000 |
| Molecular weight of Polycaprolactone | 1000 | 1000 | 2000 | 2000 | 3000 |
| ratio of molecular weight | 3 | 2 | 1 | 0.5 | 0.33 |
| Stocking | | | | | |
| 60% Recovery Stress (g) | 160 | 122 | 140 | 112 | 120 |
| 75% Extention Stress (g) | 890 | 680 | 710 | 650 | 650 |

TABLE 3

| | Strength (g/d) | | Shrinking Ratio | |
|---|---|---|---|---|
| | No. | | | |
| Heater Temperature | E(*) | C | E(*) | C |
| 30° C. | 5.1 | 5.1 | 17.0 | 18.0 |
| 60° C. | 4.6 | 4.9 | 15.5 | 16.0 |
| 80° C. | 4.4 | 4.9 | 15.0 | 15.5 |
| 100° C. | 4.2 | 5.2 | 15.5 | 15.5 |

(*)comparative example

TABLE 4

| | No. | | | | |
|---|---|---|---|---|---|
| | J | K | L | M | N |
| Polyurethane (pellet) | | | | | |
| Relative Viscosity in DMAc | 5.32 | 4.80 | 3.30 | 2.33 | 2.08 |
| Shore D | 64 | 64 | 63 | 63 | 63 |
| Polyurethane (in filament) Relative Viscosity in DMAc | 3.10 | 2.95 | 2.60 | 1.98 | 1.58 |
| Melt Spinnability | bad | no good | good | good | bad |
| Gelation in spinning pack | some existence | a little existence | no existence | no existence | no existence |

The use of a polyurethane having Shore hardness D of at least 58 enables the polyurethane polyamide conjugate fiber in accordance with the present invention to exhibit significantly improved recovery stress properties of a coil-like crimped fiber after crimp development. Thus, stretch fabric products with more improved fitting properties can be produced.

In addition, since the heat resistance is improved, it is possible to prevent the deterioration in quality during crimp developing treatment and heat setting and improve the strength-extension properties of stretch fabric products.

The conjugate fiber in accordance with the present invention can therefore be used in the same way as conventional self-crimping conjugate fibers and are particularly useful for fiber products which are required to possess a high level of fitting properties. For example, it is useful for hosiery such as stockings, socks, and tricot products.

The conjugate fiber of the present invention can be formed into a fiber finer than conventional covered elastic yarns which comprise polyurethane elastic filament covered with polyamide fibers and which are widely used in stocking products with high levels of stretchability and fitting properties. The conjugate fiber can therefore be used in stocking products with high levels of stretchability and fitting properties, as well as a high level of transparent of fabrics.

What is claimed is:

1. A polyurethane polyamide self-crimping conjugate fiber having eccentric conjugate form, comprising a polyurethane having a Shore hardness D of 60 to 75, said polyurethane being selected from the group consisting of a polycarbonate-urethane and a polyurethane containing a polycarbonate-urethane of at least 10 percent by weight as a copolymer component or a mixture component, and a polyamide having a melting point of at least 200° C.

2. A polyurethane polyamide self-crimping conjugate fiber as defined in claim 1, wherein the weight ratio between the hard segment and the soft segment of said polyurethane is 17:83 to 25:75.

3. A polyurethane polyamide self-crimping conjugate fiber as defined in claim 1, wherein the relative viscosity of said polyurethane to dimethylacetamide is 1.60 to 3.00.

4. A polyurethane polyamide self-crimping conjugate fiber as defined in claim 1, wherein said eccentric conjugate form is an eccentric sheath-core conjugate structure, said sheath being eccentially formed from said polyamide.

5. A polyurethane polyamide self-crimping conjugate fiber as defined in claim 1, wherein the compounding ratio between said polyurethane and said polyamide is 80/20 to 20/80.

6. A polyurethane polyamide self-crimping conjugate fiber as defined in claim 1, wherein a single filament of said conjugate fiber has at most 40 denier.

7. A polyurethane polyamide self-crimping conjugate fiber as defined in claim 1, wherein the retention of the product of strength and extension after heat treatment at 110° C. for 30 seconds is at least 70%.

8. A polyurethane polyamide self-crimping conjugate fiber as defined in claim 1, wherein said conjugate fiber is subjected to heat treatment of at least 60° C. after meltspinning without substantial crimp development.

9. A polyurethane polyamide self-crimping conjugate fiber having eccentric conjugate form, comprising a polyurethane having a Shore hardness D of 60 to 75 and a polyamide, wherein the crimping property of said conjugate fiber shows spring constant of at least 16.8.

10. A polyurethane polyamide self-crimping conjugate fiber as defined in claim 1, wherein said polyamide is formed essentially from polycapramide having relative viscosity to sulfuric acid of 2.0 to 2.8.

11. A filament yarn for hosiery products comprising said polyurethane polyamide self-crimping conjugate fiber as defined in claim 1.

* * * * *